US010408452B2

(12) United States Patent
Rimmer et al.

(10) Patent No.: US 10,408,452 B2
(45) Date of Patent: Sep. 10, 2019

(54) ARRAY OF EFFUSION HOLES IN A DUAL WALL COMBUSTOR

(71) Applicant: ROLLS-ROYCE plc, London (GB)

(72) Inventors: John E. T. Rimmer, Loughborough (GB); Nicholas M Brown, Nottingham (GB)

(73) Assignee: ROLLS-ROYCE plc, London (GB)

( * ) Notice: Subject to any disclaimer, the term of this patent is extended or adjusted under 35 U.S.C. 154(b) by 236 days.

(21) Appl. No.: 15/273,243

(22) Filed: Sep. 22, 2016

(65) Prior Publication Data

US 2017/0108219 A1 Apr. 20, 2017

(30) Foreign Application Priority Data

Oct. 16, 2015 (GB) ..... 1518345.2

(51) Int. Cl.
*F23R 3/00* (2006.01)
*F23R 3/06* (2006.01)
(Continued)

(52) U.S. Cl.
CPC ..... *F23R 3/002* (2013.01); *F05D 2260/201* (2013.01); *F05D 2260/202* (2013.01);
(Continued)

(58) Field of Classification Search
CPC .... F23R 3/002; F23R 3/04; F23R 3/06; F23R 3/60; F23R 2900/03041;
(Continued)

(56) References Cited

U.S. PATENT DOCUMENTS 3,777,484 A * 12/1973 Dibelius ..... F23R 3/002 60/757
4,071,194 A * 1/1978 Eckert ..... F02K 1/822 239/127.3
(Continued)

FOREIGN PATENT DOCUMENTS

| | | | |
|---|---|---|---|
| EP | 1983265 | A2 | 10/2008 |
| GB | 2298266 | A | 8/1996 |
| WO | 2015039074 | A1 | 3/2015 |

OTHER PUBLICATIONS

Apr. 19, 2017 extended Search Report issued in European Patent Application No. 16189864.8.
(Continued)

*Primary Examiner* — Todd E Manahan
*Assistant Examiner* — Eric W Linderman
(74) *Attorney, Agent, or Firm* — Oliff PLC

(57) ABSTRACT

In an embodiment of the invention, a dual-wall casing for a combustor comprises an outer wall and an inner wall defining a channel therebetween. The walls are fastened together by a bolt which extends from the inner wall and across the channel. In use, the inner wall is exposed to combustion products. Cooling is provided by a primary inlet hole extending through the outer wall and arranged upstream (with respect to the direction of flow of coolant in the channel) of the bolt and an array of effusion holes extending through the inner wall and positioned with their inlet in line of sight of the primary inlet hole. The primary inlet hole is sized with respect to the array of effusion holes such that it has a flow area which causes locally negligible flow restriction.

19 Claims, 6 Drawing Sheets

(51) Int. Cl.
*F23R 3/04* (2006.01)
*F23R 3/60* (2006.01)

(52) U.S. Cl.
CPC . *F23R 3/04* (2013.01); *F23R 3/06* (2013.01); *F23R 3/60* (2013.01); *F23R 2900/03041* (2013.01); *F23R 2900/03042* (2013.01); *F23R 2900/03044* (2013.01)

(58) Field of Classification Search
CPC .. F23R 2900/03042; F23R 2900/03044; F05D 2260/201; F05D 2260/202
See application file for complete search history.

(56) References Cited

U.S. PATENT DOCUMENTS 4,232,527 A * 11/1980 Reider ..... F23R 3/08 60/754
4,242,871 A * 1/1981 Breton ..... F23R 3/08 60/757
4,302,941 A * 12/1981 DuBell ..... F23R 3/002 60/757
4,642,993 A * 2/1987 Sweet ..... F23R 3/002 428/116
4,695,247 A * 9/1987 Enzaki ..... F23R 3/06 431/352
4,901,522 A * 2/1990 Commaret ..... F23R 3/002 60/752
5,000,005 A * 3/1991 Kwan ..... F01D 5/184 431/352
5,435,139 A * 7/1995 Pidcock ..... F23R 3/002 60/752
5,758,503 A * 6/1998 Dubell ..... F23R 3/002 60/752
5,782,294 A * 7/1998 Froemming ..... F01D 5/288 165/168
5,799,491 A * 9/1998 Bell ..... F23R 3/002 60/752
6,170,266 B1 * 1/2001 Pidcock ..... F23R 3/06 60/755
6,408,628 B1 * 6/2002 Pidcock ..... F23R 3/002 60/752
6,434,821 B1 * 8/2002 Nelson ..... B23P 15/00 29/888.01
6,513,331 B1 * 2/2003 Brown ..... F23R 3/06 60/754
6,708,499 B2 * 3/2004 Pidcock ..... F23R 3/002 60/752
6,868,675 B1 * 3/2005 Kuhn ..... F23R 3/002 60/752
7,093,439 B2 * 8/2006 Pacheco-Tougas ..... F23R 3/002 60/752
7,140,185 B2 * 11/2006 Burd ..... F23M 5/085 60/752
7,146,815 B2 * 12/2006 Burd ..... F23R 3/002 60/752
7,270,175 B2 * 9/2007 Mayer ..... F01D 25/08 165/170
7,363,763 B2 * 4/2008 Coughlan ..... F23R 3/002 60/752
7,464,554 B2 * 12/2008 Cheung ..... F23R 3/00 60/754
7,748,222 B2 * 7/2010 Bernier ..... F23R 3/002 60/752
7,874,159 B2 * 1/2011 Gerendas ..... F23R 3/002 60/752
7,926,278 B2 * 4/2011 Gerendas ..... F23R 3/002 60/725
8,099,961 B2 * 1/2012 Gerendas ..... F23R 3/002 60/752
8,161,752 B2 * 4/2012 Yankowich ..... F23R 3/005 60/752
8,695,322 B2 * 4/2014 Davis, Jr. ..... F01D 9/023 60/39.37
8,739,546 B2 * 6/2014 Snyder ..... F23R 3/06 60/752
8,745,988 B2 * 6/2014 Verhiel ..... F23R 3/007 60/752
8,794,961 B2 * 8/2014 Chandler ..... F23R 3/002 431/352
8,800,298 B2 * 8/2014 Ladd ..... F23R 3/002 60/792
9,080,447 B2 * 7/2015 McMahan ..... F01D 9/023
9,416,970 B2 * 8/2016 Kirsopp ..... F23R 3/002
9,498,848 B2 * 11/2016 Garry ..... B22F 5/009
9,506,653 B2 * 11/2016 Gerendas ..... F23R 3/002
9,518,737 B2 * 12/2016 Pidcock ..... F23R 3/002
9,518,739 B2 * 12/2016 Hu ..... F23R 3/04
9,534,783 B2 * 1/2017 Dierberger ..... F23R 3/04
9,970,660 B2 * 5/2018 Chandler ..... F23R 3/10
10,174,949 B2 * 1/2019 Cunha ..... F23R 3/002
2001/0004835 A1 * 6/2001 Alkabie ..... F23R 3/002 60/757
2002/0124572 A1 9/2002 Pidcock et al.
2004/0211188 A1 * 10/2004 Alkabie ..... F23R 3/002 60/772
2005/0241316 A1 * 11/2005 Nguyen ..... F23R 3/10 60/772
2007/0144177 A1 * 6/2007 Burd ..... F01D 9/023 60/752
2009/0277180 A1 * 11/2009 Lam ..... F23R 3/002 60/752
2010/0037620 A1 * 2/2010 Chila ..... F23R 3/06 60/752
2010/0293957 A1 * 11/2010 Chen ..... F01D 9/023 60/752
2010/0300106 A1 * 12/2010 Edwards ..... F23R 3/10 60/752
2011/0023495 A1 * 2/2011 Bronson ..... F23R 3/06 60/752
2011/0126543 A1 * 6/2011 Kirsopp ..... F23R 3/002 60/742
2012/0255308 A1 * 10/2012 Chandler ..... F23R 3/002 60/754
2013/0180257 A1 7/2013 Stastny et al.
2013/0327048 A1 * 12/2013 Cunha ..... F23R 3/002 60/772
2013/0327049 A1 * 12/2013 Cunha ..... F23R 3/005 60/772
2013/0327056 A1 * 12/2013 Cunha ..... F23R 3/06 60/782
2013/0327057 A1 * 12/2013 Cunha ..... F23R 3/002 60/782
2013/0333387 A1 * 12/2013 Leblond ..... F23R 3/002 60/722
2014/0020393 A1 * 1/2014 Nakamata ..... F23R 3/002 60/754
2014/0190171 A1 * 7/2014 Critchley ..... F23R 3/005 60/755
2014/0230440 A1 * 8/2014 Summers ..... F23R 3/005 60/722
2014/0238030 A1 * 8/2014 Gerendas ..... F23R 3/002 60/754
2014/0250896 A1 * 9/2014 Hu ..... F23R 3/04 60/772
2015/0176843 A1 * 6/2015 Garry ..... F23M 5/04 60/753
2015/0323182 A1 * 11/2015 Sandoval ..... F23R 3/02 60/752
2015/0362192 A1 * 12/2015 Cunha ..... F23R 3/002 60/772
2016/0010862 A1 * 1/2016 Balandier ..... F23R 3/007 60/753
2016/0169515 A1 * 6/2016 Tu ..... F23R 3/005 60/806
2017/0003026 A1 * 1/2017 Holdcraft ..... F23R 3/002
2017/0045226 A1 * 2/2017 Cheung ..... F23R 3/06

(56) References Cited

U.S. PATENT DOCUMENTS

OTHER PUBLICATIONS

Mar. 31, 2016 Search Report issued in British Patent Application No. GB1518345.2.

* cited by examiner

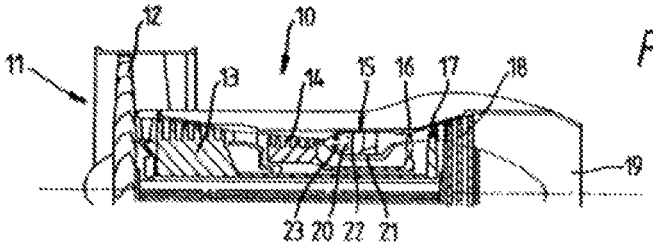
Fig.1.
PRIOR ART
Fig.2.
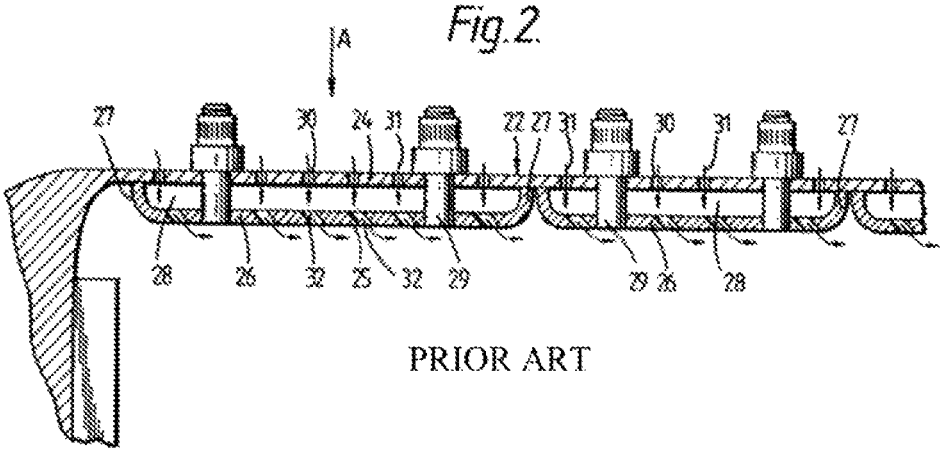
PRIOR ART

ARRAY OF EFFUSION HOLES IN A DUAL WALL COMBUSTOR

TECHNICAL FIELD

This invention relates to a combustor for a gas turbine engine and in particular to the construction of the casing of such a combustor. The invention may have wider application in dual-wall components exposed to high temperature environments.

BACKGROUND TO THE INVENTION

In a gas turbine engine, ambient air is drawn into a compressor section. Alternate rows of stationary and rotating aerofoil blades are arranged around a common axis. Together these accelerate and compress the incoming air. A rotating shaft drives the rotating blades. Compressed air is delivered to a combustor section where it is mixed with fuel and ignited. Ignition causes rapid expansion of the fuel/air mix which is directed in part to propel a body carrying the engine and in another part to drive rotation of a series of turbines arranged downstream of the combustor. The turbines share rotor shafts in common with the rotating blades of the compressor and work, through the shaft, to drive rotation of the compressor blades.

The combustion process which takes place within the combustor of a gas turbine engine results in the walls of the combustor casing being exposed to extremely high temperatures. The alloys used in combustor wall construction are normally unable to withstand these temperatures without some form of cooling. It is known to take off a portion of the air output from the compressor (which is not subjected to ignition in the combustor and so is relatively cooler) and feed this to surfaces of the combustion chamber which are likely to suffer damage from excessive heat.

A casing enclosing the combustion chamber typically comprises a "dual-wall" structure wherein outer and inner wall elements are maintained in spaced apart relationship and cooling air is directed through holes in the outer wall into a channel defined between them. In addition, arrays of effusion holes are provided in the inner wall elements through which the cooling air is exhausted. The geometry and arrangement of the effusion holes is selected to provide a substantially continuous boundary layer of cooling air along the inner wall surface, protecting the component from the extremely hot combustion product generated in the combustion chamber.

For optimal effect, the arrays typically comprise groupings of 6-8 rows of effusion holes.

Interruptions to the boundary layer can arise where obstacles along the inner wall prevent the inclusion of a sufficiently proportioned array of effusion holes in a region of the inner wall. For example, the obstacle may be part of a fastener used to secure the inner and outer walls together, a dilution hole used for emissions control, or a join between the leading edge of a liner tile and the outer casing of a combustor. Such regions can be subjected to temperature profiles which impact on the mechanical properties of the wall over time and can result in a reduction in the operational life of the component.

STATEMENT OF THE INVENTION

In accordance with a first aspect of the present invention there is provided a dual-wall component configured for use in a high temperature environment, the component comprising;

an outer wall and an inner wall defining a channel therebetween, the inner wall, in use, exposed to the high temperature, a primary inlet hole extending through the outer wall, an array of effusion holes extending through the inner wall and positioned with their entire inlet in line of sight of the primary inlet hole, the primary inlet hole sized with respect to the array of effusion holes such that it has a flow area which causes locally negligible flow restriction.

The primary inlet and the array of effusion holes may be beneficially applied in any region where surface area for the arrangement of effusion holes is limited. In one example, they are located just downstream (with respect to the direction of flow of coolant in the channel) of a join of the inner wall to the outer wall. For example, this might be where an inner tile of the combustor chamber casing meets the combustor casing.

Another practical application of the arrangement is in regions where an obstacle interrupts a channel between the inner and outer wall and prevents continuation of an array of effusion holes along the inner wall. Therefore, in accordance with another aspect of the invention there is provided a dual-wall component configured for use in a high temperature environment, the component comprising;

an outer wall and an inner wall defining a channel therebetween, one or more obstacles extending from the inner wall and into the channel, the inner wall, in use, exposed to the high temperature, a primary inlet hole extending through the outer wall and arranged upstream (with respect to the direction of flow of coolant in the channel) of the obstacle, an array of effusion holes extending through the inner wall and positioned with their entire inlet in line of sight of the primary inlet hole, the primary inlet hole sized with respect to the array of effusion holes such that it has a flow area which causes locally negligible flow restriction.

The dual-wall component may be the casing of a combustor in a gas turbine engine, though the described cooling hole arrangements may be equally applicable to other components in a gas turbine engine or other machines which operate in a high temperature environment.

For example, the obstacle is a fastener component such as a bolt for fastening the inner and outer wall together. In another example, the obstacle is a dilution hole which extends through both walls of the dual walled component.

In use, the component is fed coolant from a source through the primary inlet hole. Coolant passes along the channel and is exhausted through the effusion holes. Appropriate size and geometry of holes to achieve effusion cooling will vary with the coolant media and the temperature and pressure of the operating environment. The effusion holes are configured to direct flow exiting the channel across a surface of the inner wall forming a cooling film barrier along the wall thereby protecting the inner (and outer) wall from the damaging effects of intolerable thermal profiles.

In the example of a casing of a combustion chamber for a gas turbine engine, an effusion hole diameter is typically in the range (inclusive) of 0.4 mm to 20 mm at its inlet.

The bore of an effusion hole may, optionally, be inclined to a surface of the inner wall (less than 90 degrees at interception). The incline is towards the flow direction of coolant in the channel. For example, the incline is 15 degrees or greater, optionally 75 degrees or less. The incline may be 45 degrees or less. The effusion holes may be circular in cross section at their inlet. The diameter of the hole at the outlet may be bigger than the diameter at the inlet. The bore of the effusion hole may maintain a circular cross section to the exit or may fan out to a more oval shaped outlet. The bore may be non-linear, that is, there need not be a direct line of sight through the bore of an effusion hole. The array of effusion holes may comprise one or more rows of effusion holes.

Multiple primary inlet holes may be provided, each primary inlet hole having a different associated array of effusion holes having their inlets arranged in the line of sight of the inlet hole. For example, where the component is a substantially circumferential dual-wall component such as a wall of a casing of a combustor, multiple primary inlet holes (and their associated arrays of effusion holes) may be arranged at axial and/or circumferential intervals on the component.

For example, the primary inlet hole may have an oval or race track shaped cross section. For example, the dimensions of the primary inlet hole may be selected with respect to an associated array of effusion holes to provide a flow area which is about two to four times or greater, for example about three times or greater than the combined flow area at the inlets of the associated effusion holes. However, it will be understood that in order to obtain some level of benefit, it is essential only that the primary inlet hole has a flow area which is equal to or greater than the combined flow area at the inlets of the associated effusion holes.

Optionally, additional effusion holes may be provided between the array of effusion holes on the inner wall and the obstacle. In addition to the additional effusion holes, secondary inlet holes may be provided in the outer wall. The secondary inlet holes have smaller dimensions than the primary inlet hole and are arranged in an array facing the inlets of the array of additional effusion holes. The geometry and arrangement of the secondary inlet holes and array is selected with respect to the array of additional effusion holes to achieve a higher pressure drop across the outer wall in the region of the secondary inlet holes compared to the pressure drop across the inner wall in the region of the array of additional effusion holes. This assists in preventing flow reversal between the inner and outer walls. In one example, the required affect is achieved with at least one row of additional effusion holes in the inner wall having an associated row of secondary inlet holes in an opposing section of the outer wall, the secondary inlet holes being equal to or smaller in diameter than the inlets to the additional effusion holes and/or fewer in number than the additional effusion holes in the associated row. The secondary inlet row need not be directly aligned with the associated row of additional effusion holes. Optionally the centre of the secondary inlet holes are arranged to sit upstream of the centres of the inlets to the additional effusion holes in the associated row. More generally, the geometry of the holes/arrays is selected such that the total flow area through a secondary inlet hole row is smaller than the total flow area through the inlets of the additional effusion holes in the associated row thereby creating a favourable flow path in a direction from the secondary inlet holes to the additional effusion holes and preventing reverse flow.

In another aspect, the invention comprises a combustor wherein the combustion chamber casing comprises a dual-wall component in accordance with the invention.

In another aspect, the invention comprises a gas turbine engine including a combustor as mentioned above. In the gas turbine engine of the invention, the coolant is air from the compressor which has bypassed the fuel nozzle of the combustor.

BRIEF DESCRIPTION OF THE DRAWINGS

Embodiments of the invention including characteristics which distinguish it from the prior art will now be further described with reference to the accompanying figures in which;

FIG. 1 is a sectional side view of the upper half of a ducted fan gas turbine engine as is known in the prior art;

FIG. 2 is a sectional side view of a portion of the wall of the combustor of the gas turbine engine shown in FIG. 1

DETAILED DESCRIPTION OF DRAWINGS AND EMBODIMENTS

Figure 3:
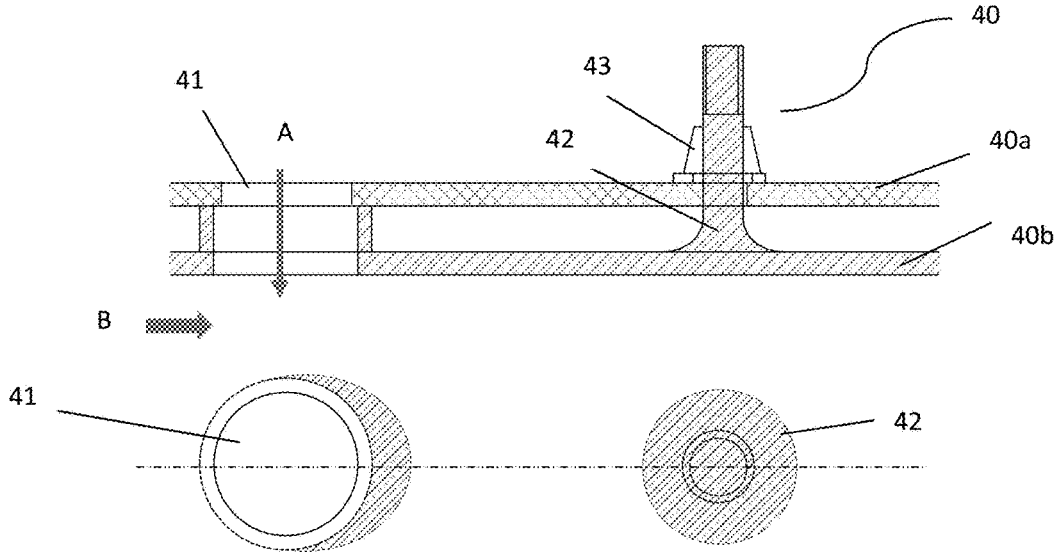
FIG. 3 shows schematically, obstacles which can result in interruption of a cooling boundary layer provided using prior art dual-wall component cooling arrangements.

With reference to FIG. 1 a ducted fan gas turbine engine generally indicated at 10 comprises, in axial flow series, an air intake 11, a propulsive fan 12, an intermediate pressure compressor 13, a high pressure compressor 14, combustion equipment 15, a high pressure turbine 16, an intermediate pressure turbine 17, a low pressure turbine 18 and an exhaust nozzle 19.

The gas turbine engine 10 works in the conventional manner so that air entering the intake 11 is accelerated by the fan 12 to produce two air flows: a first air flow into the intermediate pressure compressor 13 and a second airflow which provides propulsive thrust. The intermediate pressure compressor 13 compresses the air flow directed into it before delivering that air to the high pressure compressor 14 where further compression takes place.

The compressed air exhausted from the high pressure compressor 14 is directed into the combustion equipment 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbines 16, 17 and 18 respectively drive the high and intermediate pressure compressors 14 and 13 and the fan 12 by suitable interconnecting shafts.

The combustion equipment 15 is constituted by an annular combustor 20 having radially inner and outer wall structures 21 and 22 respectively. Fuel is directed into the combustor 20 through a number of fuel nozzles (not shown) located at the upstream end 23 of the combustor 20. The fuel nozzles are circumferentially spaced around the engine 10 and serve to spray fuel into air derived from the high pressure compressor 14. The resultant fuel/air mixture is them combusted within the combustor 20.

The combustion process which takes place within the combustor 20 naturally generates a large amount of heat. It is necessary therefore to arrange that the inner and outer wall structures 21 and 22 are capable of withstanding this heat while functioning in a normal manner.

The radially outer wall structure 22 can be seen more clearly if reference is now made to FIG. 2. It will be appreciated, however, that the radially inner wall structure 21 is of the same general configuration as the radially outer wall structure 22.

Referring to FIG. 2, the radially outer wall structure 22 comprises an outer wall 24 and an inner wall 25, the inner wall 25 is made up of a plurality of discreet wall elements 26 which are all of the same general rectangular configuration and are positioned adjacent to each other. The majority of each wall element 26 is arranged to be equi-distant from the outer wall 24. However, the periphery of each wall element 26 is provided with a continuous flange 27 to facilitate the spacing apart of the wall element 26 and the outer wall 24. It will be seen therefore that a chamber 28 is thereby defined between each wall element 26 and the outer wall 24.

Each wall element 26 is of cast construction and is provided with integral bolts 29 which facilitate its attachment to the outer wall 24.

During engine operation, some of the air exhausted from the high pressure compressor 14 is permitted to flow over the exterior surfaces of the combustor 20 to provide cooling. Additionally, some of this air is directed into the interior of the combustor 20 to assist in the combustion process. A large number of holes 30 are provided in the outer wall 24 to permit the flow of some of this air into the chamber 28. The air passing through the holes 30 impinges upon the radially outward surfaces of the wall elements 26 as indicated by the air flow indicating arrows 31. This air is then exhausted from the chamber 28 through, a plurality of angled effusion holes 32 provided in inner wall element 26. The effusion holes 32 are so angled as to be aligned in a generally downstream direction with regard to the general fluid flow through the combustor 20.

It will be noted that the integral bolts 29 can present an obstacle to the inclusion of effusion holes (for example not allowing space for an array of up to eight rows for optimal cooling in a region) and as a consequence a portion of the inner wall component 26 in the vicinity of the bolt 29 may not be optimally cooled by the prior art arrangement. The inner and outer wall structures 21 and 22 could benefit from being dual-wall components having a configuration in accordance with the invention.

Other gas turbine engines to which the present disclosure may be applied may have alternative configurations. By way of example such engines may have an alternative number of interconnecting shafts (e.g. three) and/or an alternative number of compressors and/or turbines. Further the engine may comprise a gearbox provided in the drive train from a turbine to a compressor and/or fan.

FIG. 3 shows schematically a dual walled component 40, absent any cooling holes. The component is representative of a wall of a combustion chamber of a gas turbine engine. The component comprises outer and inner walls 40*a* and 40*b*. A flanged dilution hole 41 extends through walls 40*a* and 40*b* and a bolt 42 extends from the inner wall 40*b* and through an engaging hole in the outer wall 40*a* where it is secured by a nut 43 thereby holding the inner and outer walls 40*a*, 40*b* in alignment. In operation, compressed air which has bypassed the fuel nozzle is drawn into the chamber through the dilution hole 41 as represented by arrow A. Combustion gases pass from an upstream nozzle along a path represented by arrow B. The streams merge and the dilution air A entering the chamber is carried downstream with the dominant combustion gas stream B.

Figure 4:
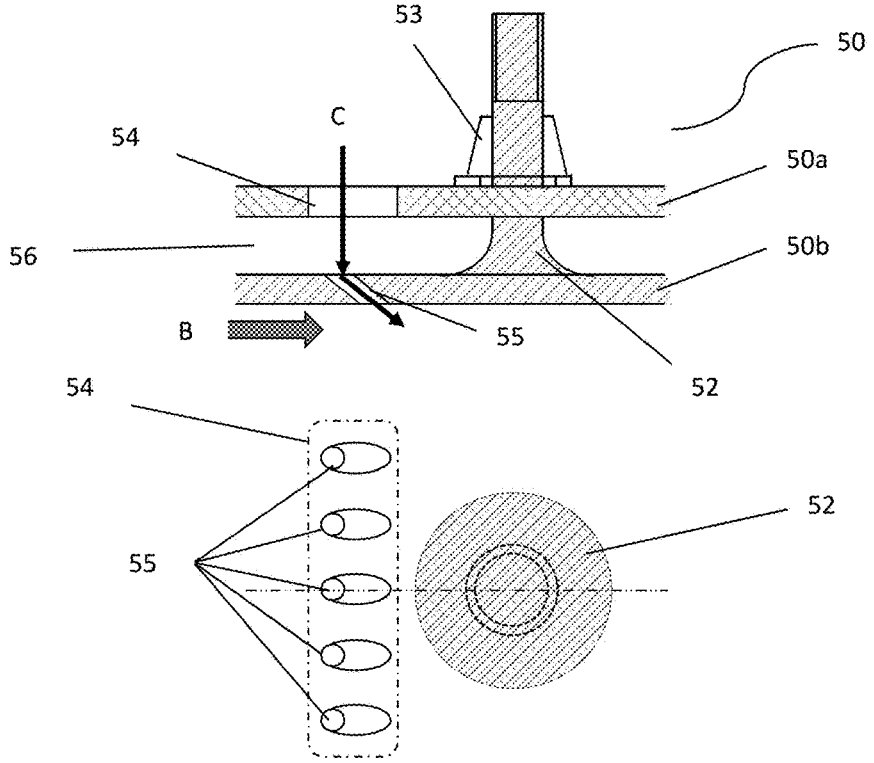
FIG. 4 shows a first embodiment of a dual-wall component configured in accordance with the invention.

FIG. 4 shows a first embodiment of the invention as applied to a region just upstream of and including the bolt 42 of the dual wall component 40 of FIG. 3. In the embodiment of FIG. 4, the component comprises outer and inner walls 50*a* and 50*b*. A bolt 52 extends from the inner wall 50*b* and through an engaging hole in the outer wall 50*a* where it is secured by a nut 53 thereby holding the inner and outer walls 50*a*, 50*b* in alignment. A primary inlet hole 54 is provided in the outer wall 50*a* a short distance upstream (with respect to flow direction B) of the bolt 52. In the inner wall 50*b* within the direct line of sight of the primary input hole 54 there is provided an array of effusion holes 55. The primary inlet hole 54 has a rounded rectangle or "racetrack" shape. As can be seen, the flow area of the primary inlet hole 54 is significantly larger than the combined flow area of the inlet ends of the effusion holes 55. The effusion holes 55 are aligned in a row within the direct line of sight of the primary inlet hole 54 and are angled to a surface of the inner wall to the flow direction B. In operation, compressed air which has bypassed the fuel nozzle is drawn into a channel 56 bounded by inner and outer walls 50*a*, 50*b* through the primary inlet hole 54. A pressure drop across inner wall 50*b* partly created by the flowing combustion gases B draws the compressed air through the effusion holes 55 along a flow path represented in the figure by arrows C.

Figure 5:
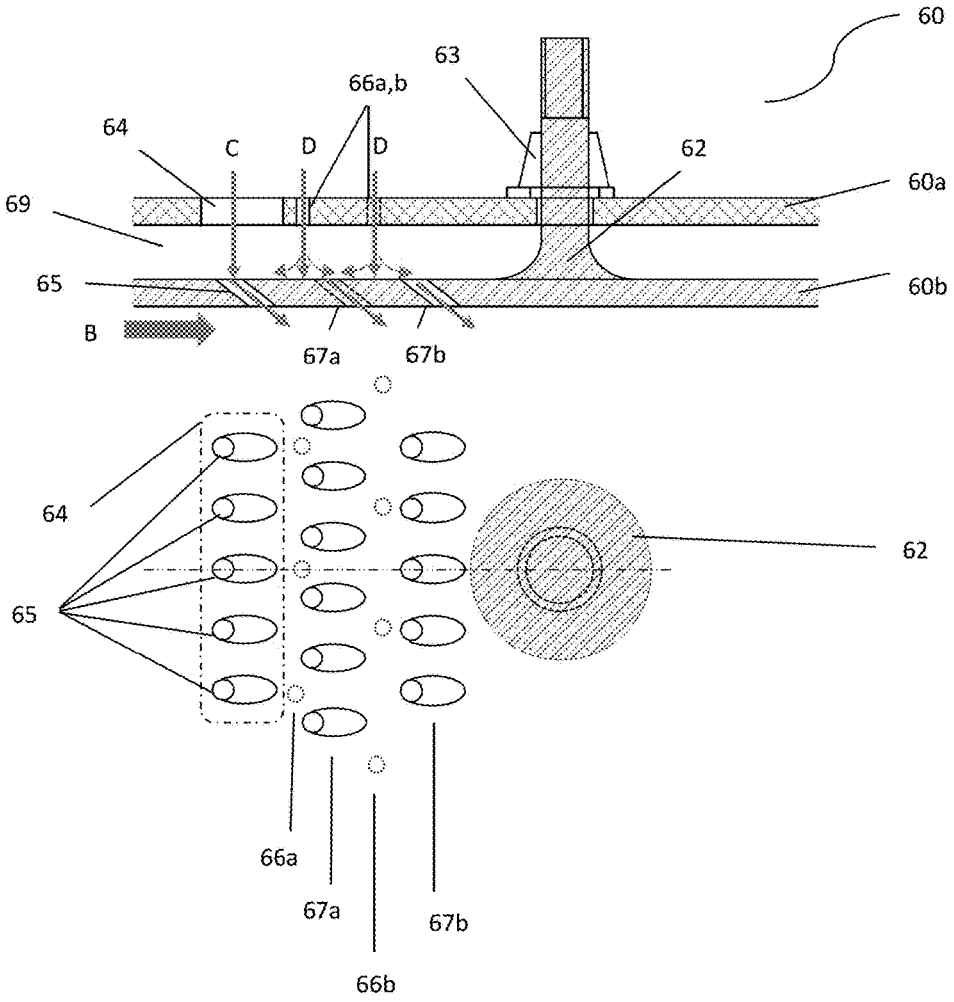
FIG. 5 shows a second embodiment of a dual-wall component configured in accordance with the invention.

FIG. 5 shows a second embodiment of the invention. In this Figure, the component 60 comprises outer and inner walls 60*a* and 60*b*. A bolt 62 extends from the inner wall 60*b* and through an engaging hole in the outer wall 60*a* where it is secured by a nut 63 thereby holding the inner and outer walls 60*a*, 60*b* in alignment. A primary inlet hole 64 is provided in the outer wall 60*a* a short distance upstream (with respect to flow direction B) of the bolt 62. In the inner wall 60*b* within the direct line of sight of the primary input hole 64 there is provided an array of effusion holes 65. The primary inlet hole 64 has a rounded rectangle or "racetrack" shape. As can be seen, the flow area of the primary inlet hole 64 is significantly larger than the combined flow area of the inlet ends of the effusion holes 65. The effusion holes 65 are aligned in a row within the direct line of sight of the primary inlet hole 64 and are angled to a surface of the inner wall to the flow direction B. In operation, compressed air which has bypassed the fuel nozzle is drawn into a channel 69 bounded by inner and outer walls 60*a*, 60*b* through the primary inlet hole 64. A pressure drop across inner wall 60*b* partly created by the flowing combustion gases B draws the compressed air through the effusion holes 65 along a flow path represented in the figure by arrows C.

Arranged between the primary inlet hole 64 and the bolt 62 in the outer wall 60*a* are secondary inlet holes 66*a* and 66*b*. As can be seen in the face on representation of the inner wall 60*b* inner face, these secondary inlet holes are of much smaller diameter and are arranged in axially displaced rows. Associated with each row 66*a*; 66*b* of secondary inlet holes is a row of additional effusion holes 67*a*; 67*b* which are provided in the inner wall 60*b*. A centreline of inlets to the additional effusion holes 67*a*; 67*b* is slightly axially displaced in a downstream direction (with respect to flow direction B) from a centreline of the secondary inlet holes 66*a*; 66*b*. The total flow area of secondary inlets 66*a*; 66*b* in a row is selected to be smaller than the total flow area of inlets to the additional effusion holes 67*a*; 67*b* in the corresponding row. For example, the total flow area of the row of inlet holes 66*a* is less than the total flow area at the inlet of the row of additional effusion holes 67*a* and the total flow area of the row of inlet holes 66*b* is less than the total flow area at the inlet of the row of additional effusion holes 67*b*. This arrangement results in coolant entering the channel 69 and following the flow path represented by arrows D where it is drawn through additional effusion holes 67*a*, 67*b* and effusion holes 65 extending a cooling barrier provided by cooling air exiting the effusion holes 65.

Figure 6:
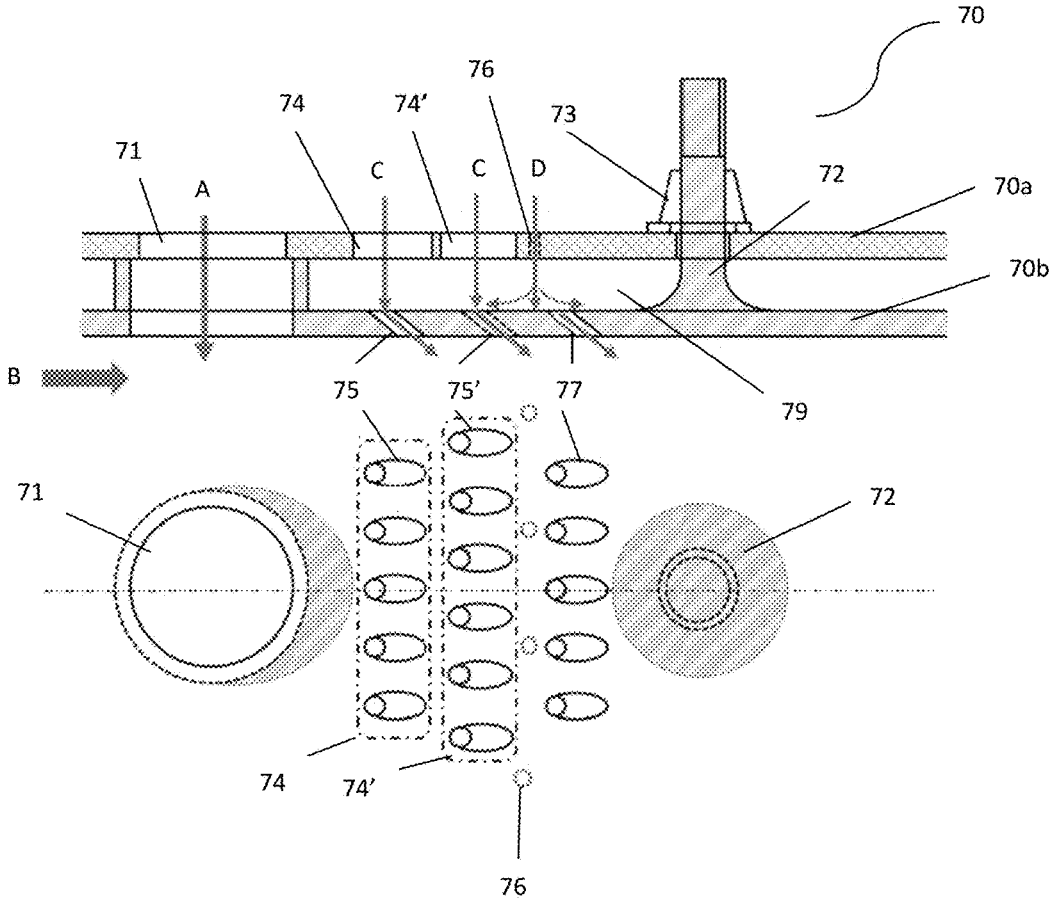
FIG. 6 shows a third embodiment of a dual-wall component configured in accordance with the invention.

FIG. 6 shows another embodiment of the invention. In this Figure, the component 70 comprises outer and inner walls 70*a* and 70*b*. A bolt 72 extends from the inner wall 70*b* and through an engaging hole in the outer wall 70*a* where it is secured by a nut 73 thereby holding the inner and outer walls 70*a*, 70*b* in alignment. A first primary inlet hole 74 is provided in the outer wall 70*a* a short distance upstream (with respect to flow direction B) of the bolt 72. In the inner wall 70*b* within the direct line of sight of the first primary input hole 74 there is provided an array of effusion holes 75. The first primary inlet hole 74 has a rounded rectangle or "racetrack" shape. As can be seen, the flow area of the primary inlet hole 74 is significantly larger than the combined flow area of the inlet ends of the effusion holes 75. The effusion holes 75 are aligned in a row within the direct line of sight of the first primary inlet hole 74 and are angled to a surface of the inner wall to the flow direction B. In operation, compressed air which has bypassed the fuel nozzle is drawn into a channel 79 bounded by inner and outer walls 70*a*, 70*b* through the first primary inlet hole 74. A pressure drop across inner wall 70*b* partly created by the flowing combustion gases B draws the compressed air through the effusion holes 75 along a flow path represented in the figure by arrows C.

Just downstream of the first primary inlet hole 74 is provided a second primary inlet hole 74'. The second primary inlet hole 74' has an associated array of effusion holes 75' provided in the inner wall 70*b*.

Arranged between the second primary inlet hole 74' and the bolt 72 in the outer wall 70*a* are secondary inlet holes 76. As can be seen in the face on representation of the inner wall 70 inner face, these secondary inlet holes are of much smaller diameter and are arranged in a row. Associated with the row 76 of secondary inlet holes is a row of additional effusion holes 77 which are provided in the inner wall 70*b*. A centreline of inlets to the additional effusion holes 77 is slightly axially displaced in a downstream direction (with respect to flow direction B) from a centreline of the secondary inlet holes 76. The total flow area of secondary inlets 76 is selected to be smaller than the total flow area of inlets to the additional effusion holes 77.

Figure 7:
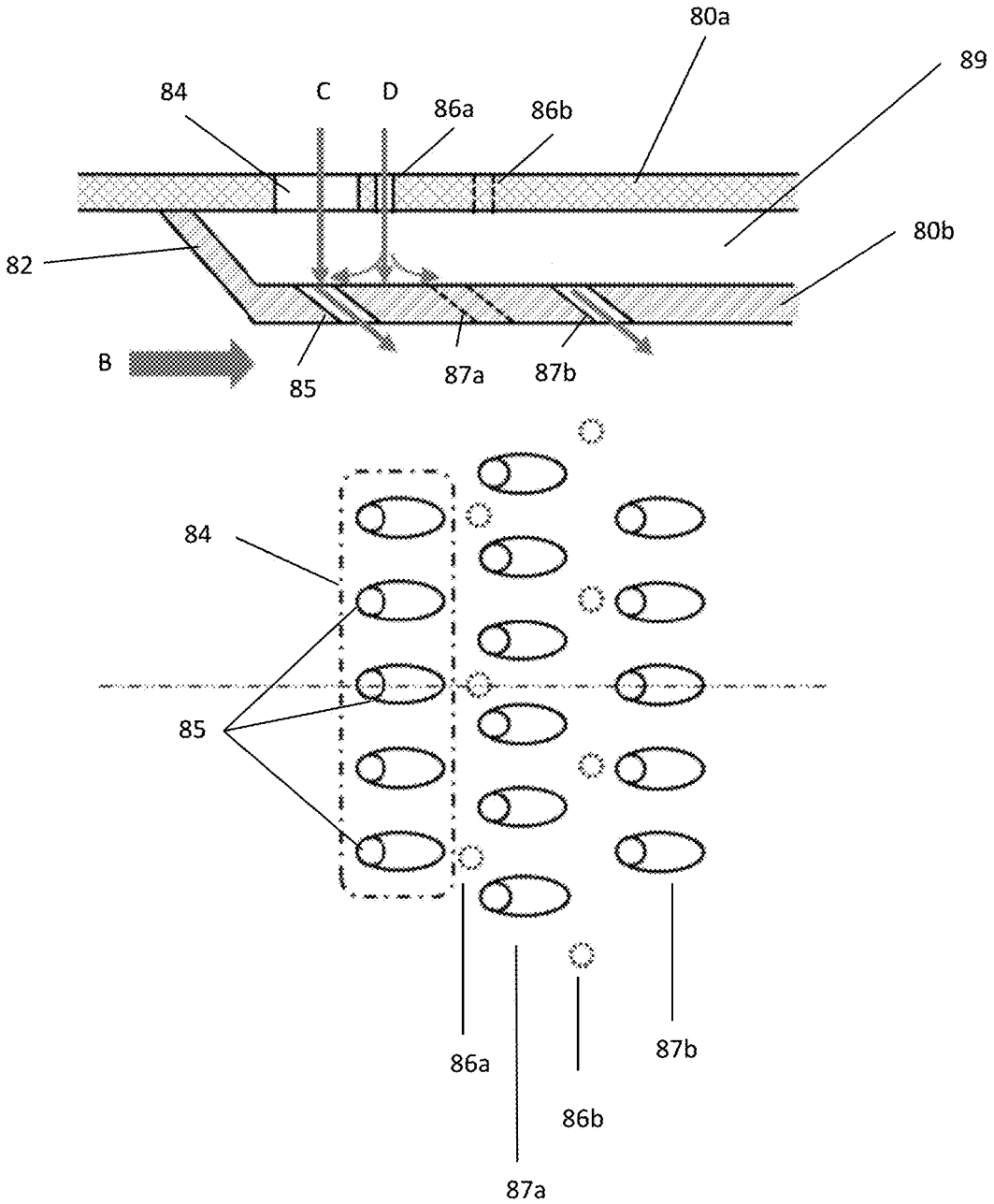
FIG. 7 shows a fourth embodiment of a dual-wall component configured in accordance with the invention.

FIG. 7 shows a fourth embodiment of the invention. In this Figure, the component 80 comprises outer and inner walls 80*a* and 80*b*. The inner wall 80*b* is a cooling tile and the outer wall 80*a*, the casing of a combustion chamber. A leading edge 82 of a cooling tile extends from the inner wall 80*b* to meet the outer wall 80*a*. A primary inlet hole 84 is provided in the outer wall 80*a* a short distance downstream (with respect to flow direction B) of the leading edge 82. In the inner wall 80*b* within the direct line of sight of the primary input hole 84 there is provided an array of effusion holes 85. The primary inlet hole 84 has a rounded rectangle or "racetrack" shape. As can be seen, the flow area of the primary inlet hole 84 is significantly larger than the combined flow area of the inlet ends of the effusion holes 85. The effusion holes 85 are aligned in a row within the direct line of sight of the primary inlet hole 84 and are angled to a surface of the inner wall to the flow direction B. In operation, compressed air which has bypassed the fuel nozzle is drawn into a channel 89 bounded by inner and outer walls 80*a*, 80*b* through the primary inlet hole 84. A pressure drop across inner wall 80*b* partly created by the flowing combustion gases B draws the compressed air through the effusion holes 85 along a flow path represented in the figure by arrows C.

Arranged adjacently downstream of the primary inlet hole 84 in the outer wall 80*a* are secondary inlet holes 86*a* and 86*b*. As can be seen in the face on representation of the inner wall 80*b* inner face, these secondary inlet holes are of much smaller diameter and are arranged in axially displaced rows. Associated with each row 86*a*; 86*b* of secondary inlet holes is a row of additional effusion holes 87*a*; 87*b* which are provided in the inner wall 80*b*. A centreline of inlets to the additional effusion holes 87*a*; 87*b* is slightly axially displaced in a downstream direction (with respect to flow direction B) from a centreline of the secondary inlet holes 86*a*; 86*b*. The total flow area of secondary inlets 86*a*; 86*b* in a row is selected to be smaller than the total flow area of inlets to the additional effusion holes 87*a*; 87*b* in the corresponding row. For example, the total flow area of the row of inlet holes 86*a* is less than the total flow area at the inlet of the row of additional effusion holes 87*a* and the total flow area of the row of inlet holes 86*b* is less than the total flow area at the inlet of the row of additional effusion holes 87*b*. This arrangement results in coolant entering the channel 89 and following the flow path represented by arrows D where it is drawn through additional effusion holes 87*a*, 87*b* and effusion holes 85 extending a cooling barrier provided by cooling air exiting the effusion holes 85.

Figure 8:
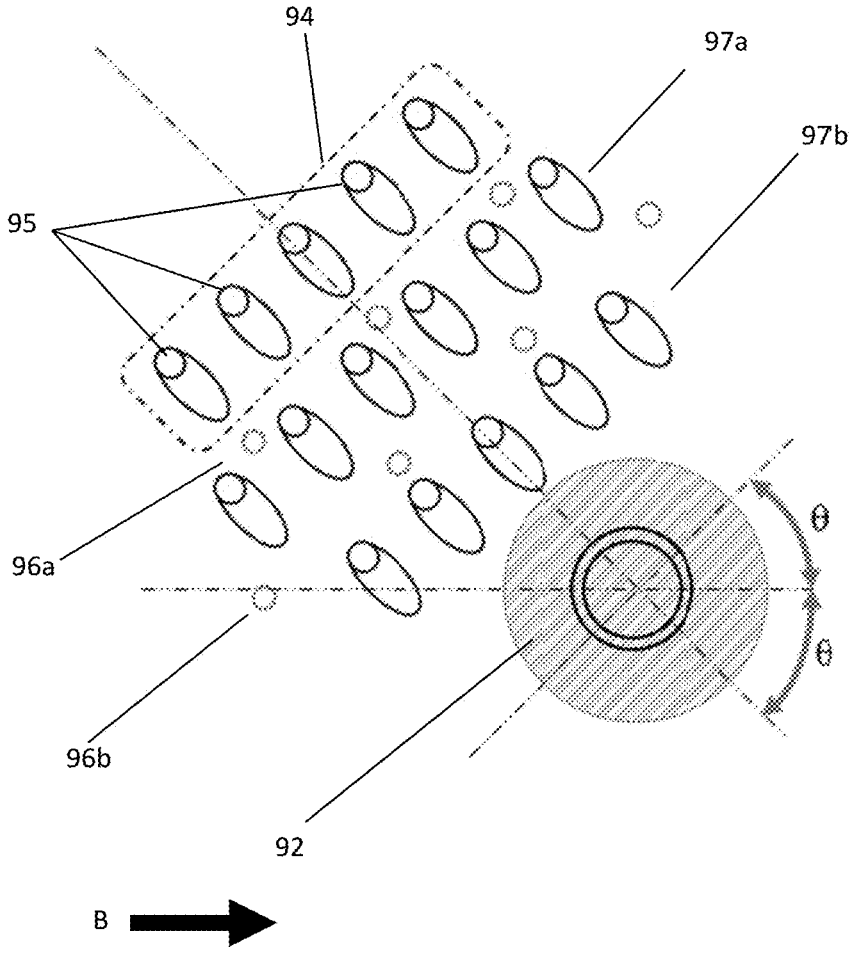
FIG. 8 shows a fifth embodiment of a dual-wall component configured in accordance with the invention.

FIG. 8 shows a fifth embodiment of the invention. The figure shows a face on view of the inner wall of a component which includes an array of cooling holes substantially similar to that shown in FIG. 5. A bolt 92 extends from the inner wall facilitating securement to an outer wall. A primary inlet hole 94 is provided in the outer wall a short distance upstream (with respect to flow direction B) of the bolt 92. In the inner wall, within the direct line of sight of the primary input hole 94 there is provided an array of effusion holes 95. The primary inlet hole 94 has a rounded rectangle or "racetrack" shape. As can be seen, the flow area of the primary inlet hole 94 is significantly larger than the combined flow area of the inlet ends of the effusion holes 95. The effusion holes 95 are aligned in a row within the direct line of sight of the primary inlet hole 94 and are angled to a surface of the inner wall to the flow direction B.

Arranged between the primary inlet hole 94 and the bolt 92 in the outer wall 90*a* are secondary inlet holes 96*a* and 96*b*. As can be seen, these secondary inlet holes 96*a*, 96*b* are of much smaller diameter and are arranged in axially displaced rows. Associated with each row 96*a*; 96*b* of secondary inlet holes is a row of additional effusion holes 97*a*; 97*b* which are provided in the inner wall 90*b*. A centreline of inlets to the additional effusion holes 97*a*; 97*b* is slightly axially displaced in a downstream direction (with respect to flow direction B) from a centreline of the secondary inlet holes 96*a*; 96*b*. The total flow area of secondary inlets 96*a*; 96*b* in a row is selected to be smaller than the total flow area of inlets to the additional effusion holes 97*a*; 97*b* in the corresponding row. For example, the total flow area of the row of inlet holes 96*a* is less than the total flow area at the inlet of the row of additional effusion holes 97*a* and the total flow area of the row of inlet holes 96*b* is less than the total flow area at the inlet of the row of additional effusion holes 97*b*. This arrangement results in coolant entering the channel 99 and following the flow path represented by arrows D where it is drawn through additional effusion holes 97*a*, 97*b* and effusion holes 95 extending a cooling barrier provided by cooling air exiting the effusion holes 95.

The arrangement differs from that of FIG. 5 in that the pattern of the holes 94, 95, 96*a*, 96*b*, 97*a*, 97*b* is rotated about a line axial to the centre of the bolt 92. The pattern rotation angle is selected to satisfy one or more of the following requirements (i) the effusion hole exit mass flow is positioned to achieve a cooling film over the feature being cooled (ii) the effusion hole exit mass flow is aligned to the bulk combustor flow. Optimising the rotational angle of the pattern will enhance the formation of a cooling film on the shown surface. Whilst not critical, the angle of the pattern may be +/−about 45 degrees to the axis of the combustor. The skilled person will appreciate that except where mutually exclusive, a feature described in relation to any one of the above aspects may be applied mutatis mutandis to any other aspect. Furthermore except where mutually exclusive any feature described herein may be applied to any aspect and/or combined with any other feature described herein.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

The invention claimed is:

1. A dual-wall component configured for use in a high temperature environment, the dual-wall component comprising:

an outer wall and an inner wall defining a channel therebetween, the inner wall, in use, exposed to the high temperature environment, a fastener that extends from the outer wall to the inner wall, a primary inlet hole extending through the outer wall, an array of effusion holes extending through the inner wall and positioned with inlets of the entire array in direct line of sight of the primary inlet hole and with the inlets of the entire array directly beneath the primary inlet in a radial direction hole, the fastener, the primary inlet hole and at least one effusion hole of the plurality of effusion holes axially align with each other along an axial direction of the channel, and the primary inlet hole sized with respect to the array of effusion holes such that the array of effusion holes has a flow area which causes locally negligible flow restriction.

2. The dual-wall component as claimed in claim 1 wherein the primary inlet hole and the array of effusion holes are located just upstream, with respect to a direction of flow of coolant in the channel, of the fastener.

3. The dual-wall component as claimed in claim 1 wherein the array of effusion holes have a diameter in the range (inclusive) of 0.4 mm to 20 mm at their inlet.

4. The dual-wall component as claimed in claim 1 wherein bores respective of the array of effusion holes are inclined to a surface of the inner wall and, in use, an incline is towards a flow direction of coolant delivered to the channel.

5. The dual-wall component as claimed in claim 4 wherein the incline is 15 degrees or greater and less than 90 degrees.

6. The dual-wall component as claimed in claim 1 comprising multiple primary inlet holes, each primary inlet hole having a different associated array of effusion holes having their entire inlets arranged in the direct line of sight of the primary inlet hole.

7. The dual-wall component as claimed in claim 1 wherein the or each primary inlet hole has a race track shaped cross section.

8. The dual-wall component as claimed in claim 1 wherein the dimensions of the primary inlet hole are selected with respect to an associated array of the array of effusion holes to provide a flow area which is two to four times the combined flow area at the inlets of the associated effusion holes.

9. The dual-wall component as claimed in claim 2 further comprising additional effusion holes provided between the array of effusion holes on the inner wall and the fastener and an array of secondary inlet holes provided in the outer wall, wherein the geometry and arrangement of the secondary inlet holes is selected with respect to the array of additional effusion holes to achieve a higher pressure drop across the outer wall in the region of the secondary inlet holes compared to the pressure drop across the inner wall in the region of the array of additional effusion holes.

10. The dual-wall component as claimed in claim 9 wherein the total flow area through a secondary inlet hole row is smaller than the total flow area through the inlets of the additional effusion holes in the associated row thereby creating a favourable flow path in a direction from the secondary inlet holes to the additional effusion holes and preventing reverse flow.

11. The dual-wall component as claimed in claim 9 wherein a centreline of the secondary inlet holes sits upstream of a centreline of the inlets to the additional effusion holes in the associated row.

12. The dual-wall component as claimed in claim 9 wherein the pattern of the holes is rotated about a line axial to the centre of the fastener.

13. The dual wall component as claimed in claim 12 wherein the angle of the rotation is +/−45 degrees.

14. The dual-wall component as claimed in claim 1 wherein the inner wall comprises an inner tile of a combustor chamber and the outer wall comprises an outer casing of the combustion chamber.

15. The dual-wall component as claimed in claim 12 further comprising additional effusion holes provided adjacently downstream of the array of effusion holes on the inner wall and an array of secondary inlet holes provided in the outer wall, wherein the geometry and arrangement of the secondary inlet holes is selected with respect to the array of additional effusion holes to achieve a higher pressure drop across the outer wall in the region of the secondary inlet holes compared to the pressure drop across the inner wall in the region of the array of additional effusion holes.

16. The dual-wall component as claimed in claim 1 wherein the primary inlet hole has a rectangular cross sectional shape.

17. A dual-wall component configured for use in a high temperature environment, the dual-wall component comprising:

an outer wall and an inner wall defining a channel therebetween;

one or more fasteners extending from the inner wall and into the channel;

the inner wall, in use, exposed to the high temperature environment;

a primary inlet hole extending through the outer wall and arranged upstream, with respect to a direction of flow of coolant in the channel, of one or more fasteners;

an array of effusion extending through the inner wall and positioned with inlets of the entire array in direct line of sight of the primary inlet hole and with the inlets of the entire array directly beneath the primary inlet hole in a radial direction;

the one or more fasteners, the primary inlet hole and at least one effusion hole of the plurality of effusion holes axially align with each other along an axial direction of the channel; and the primary inlet hole sized with respect to the array of effusion holes such that the array of effusion holes has a flow area which causes locally negligible flow restriction.

18. A combustor for a gas turbine engine wherein a combustion chamber casing comprises the dual walled component in accordance with claim 17.

19. The gas turbine engine including the combustor as claimed in claim 18 and a compressor upstream of the combustor.

* * * * *